US005143009A

United States Patent [19]

Laukien

[11] Patent Number: 5,143,009

[45] Date of Patent: Sep. 1, 1992

[54] UNDERWATER VEHICLE WITH A PASSIVE OPTICAL OBSERVATION SYSTEM

[76] Inventor: Günther Laukien, Silberstreifen, Rheinstetten-Forchheim, Fed. Rep. of Germany

[21] Appl. No.: 602,319

[22] PCT Filed: Mar. 15, 1990

[86] PCT No.: PCT/DE90/00196

§ 371 Date: Nov. 15, 1990

§ 102(e) Date: Nov. 15, 1990

[87] PCT Pub. No.: WO90/10573

PCT Pub. Date: Sep. 20, 1990

[30] Foreign Application Priority Data

Mar. 16, 1989 [DE] Fed. Rep. of Germany ..... 3908575

[51] Int. Cl.[5] ..... B63B 3/13

[52] U.S. Cl. ..... 114/66

[58] Field of Search ..... 114/66, 67, 177, 313; 350/319, 418; 52/80, 200

[56] References Cited

U.S. PATENT DOCUMENTS

| | | | |
|---|---|---|---|
| 3,757,725 | 9/1973 | Horn | 114/66 |
| 4,276,851 | 7/1981 | Coleman | 114/66 |
| 4,588,261 | 5/1986 | Erhardt . | |
| 4,809,630 | 3/1989 | Walker | 114/66 |
| 4,840,458 | 6/1989 | Cliffton | 114/66 |
| 4,852,508 | 8/1989 | Takada | 114/66 |

FOREIGN PATENT DOCUMENTS

| | | |
|---|---|---|
| 758461 | 7/1942 | Fed. Rep. of Germany . |
| 2060919 | 12/1970 | Fed. Rep. of Germany . |
| 2637735 | 8/1976 | Fed. Rep. of Germany . |
| 2837134 | 8/1978 | Fed. Rep. of Germany . |
| 2853214 | 12/1978 | Fed. Rep. of Germany . |
| 3432423 | 9/1984 | Fed. Rep. of Germany . |
| 492335 | 7/1915 | France . |
| 1130523 | 8/1955 | France . |
| 1267959 | 6/1960 | France . |
| 8700501 | 7/1986 | PCT Int'l Appl. . |

OTHER PUBLICATIONS

Literature: Transactions of the A.S.M.E.—Journal of Engineering for Industry, vol. 98, No. 2, May 1976, Author J. D. Stachiw et al. "Spherical shell sector operational depth for submersible ALVIN" pp. 523–536.

*Primary Examiner*—Jesûs D. Sotelo
*Assistant Examiner*—Stephen P. Avila
*Attorney, Agent, or Firm*—Rosenblum, Parish & Isaacs

[57] ABSTRACT

An underwater vehicle is disclosed being equipped with a passive optical observation system. The underwater vehicle has an observation window at its disposal which exhibits a diameter in the range from 0.3 to 3.0 m and a curved surface. In order to increase the sensitivity of the passive optical observation system and the ability to detect distant objects, the observation window is part of the passive optical observation system. The entrance pupil of the observation system exhibits a diameter in excess of 0.1 m.

8 Claims, 4 Drawing Sheets

UNDERWATER VEHICLE WITH A PASSIVE OPTICAL OBSERVATION SYSTEM

Figure 1:
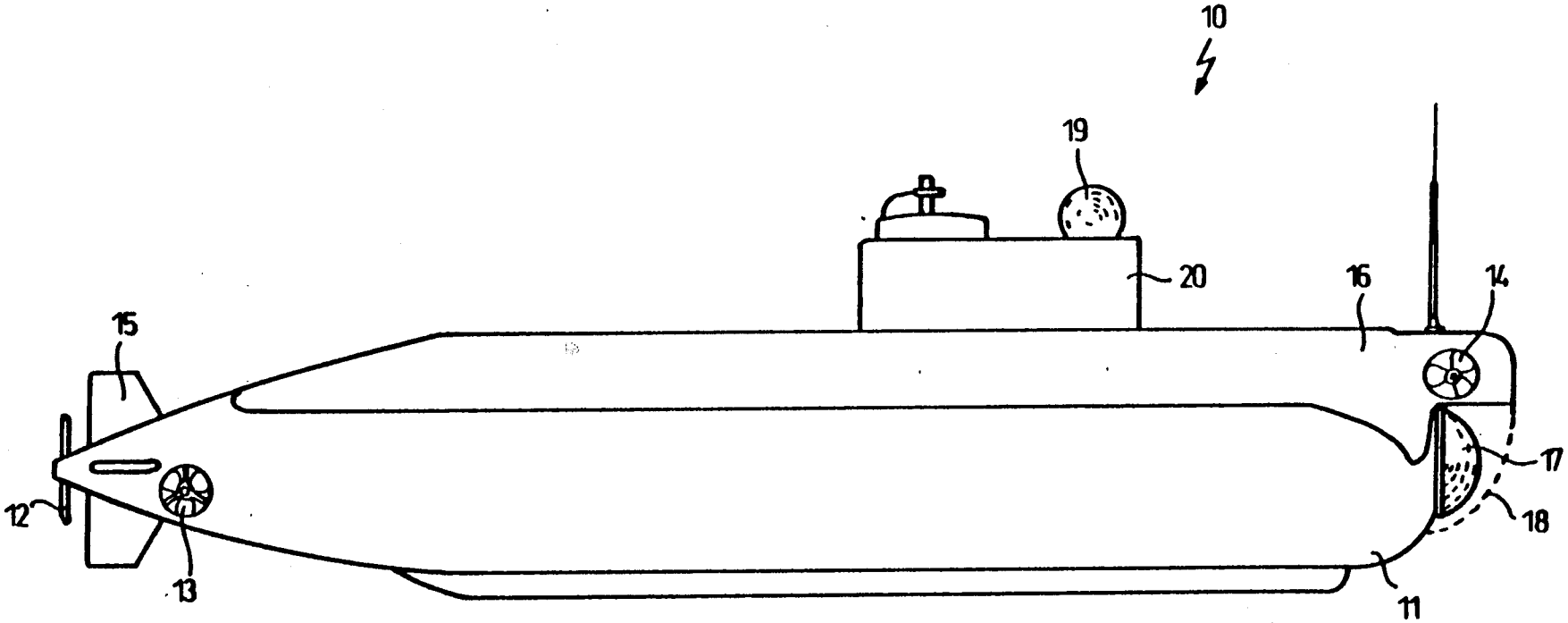

The invention concerns an underwater vehicle with a passive optical observation system, equipped with an observation window which has a diameter ranging from 0.3 to 3.0 m and a curved surface.

This application is related to the following co-pending U.S. application filed on Nov. 15, 1990:

1) U.S. patent application entitled "METHOD FOR INFLUENCING AN ACOUSTIC SOURCE, IN PARTICULAR OF A SUBMERGED SUBMARINE, AND SUBMARINE", Ser. No. 07/614,300, filed Nov. 15, 1990, corresponding to International Application PCT/DE 90/00197;
2) U.S. patent application entitled "METHOD AND APPARATUS FOR REDUCING ACOUSTIC EMISSION FROM SUBMERGED SUBMARINES", Ser. No. 07/602,310, filed Nov. 15, 1990, corresponding to International Application PCT/DE 90/00192;
3) U.S. patent application entitled "METHOD AND APPARATUS FOR LOCALIZING SUBMARINES", Ser. No. 07/615,423, filed Nov. 15, 1990, corresponding to International Application PCT/DE 90/00193;
4) U.S. patent application entitled "METHOD FOR OPERATING SUBMERGED SUBMARINES AND SUBMARINES", Ser. No. 07/602,317, filed Nov. 15, 1990, corresponding to International Application PCT/DE 90/00194;
5) U.S. patent application entitled "METHOD AND APPARATUS FOR REDUCING ACOUSTIC EMISSION FROM SUBMERGED SUBMARINES", Ser. No. 07/614,200, filed Nov. 15, 1990, corresponding to International Application PCT/DE 90/00195.
6) German Patent Application P3908573.2 entitled "METHOD AND APPARATUS FOR OPERATING SUBMERGED SUBMARINES".

Underwater vehicles of the above mentioned kind are known in the art, e.g. as so-called work submarines. A work submarine of this kind is manufactured under the model name "SEAHORSE" by BRUKER Meerestechnik GmbH. The invention relates however also to other underwater vehicles e.g. diving bells, towed vehicles or even stationary installations.

Providing the most different kinds of submarines with observation windows is known in the art. If the diameter of the observation window is small in comparison to the possible diving depth, e.g. less than 20 cm at a diving depth of 300 m, flat glass plates of appropriate thickness are normally used for the observation windows. Such small observation windows, however, are too small for the most widely varying observation tasks as well as for the manoeuvring of the work submarines. Therefore, providing large-area panoramic observation windows made of acrylic glass which exhibit a shape of a spherical surface section is also known in the art. For work submarines with a nominal diving depth of approximately 300 m, observation windows of this kind, having a diameter of 1 to 2 m, are known in the art whereby the spherical surface section formed by the window corresponds, for example, to a center opening angle of approximately 120 degrees. In this range of diving depths, smaller observation glass cupolas are also known in the art whose center opening angles exceed 300 degrees and which are sufficiently large to accommodate the head of an observer who, as a result, has an panoramic view of 180 degrees with an azimuth of more than 90 degrees.

In the above mentioned observation windows, it is considered very important that their wall thickness is constant in order to avoid optical observation errors. In observation systems known in the art, passive optical observation systems are, namely, used, in the most simple case, the naked eye of the observer. However, observing by looking through the observation windows explained above with the aid of technical optical systems, e.g. by means of a video camera, is also known in the art.

In the configurations known in the art, the observation capability decreases rapidly, in particular when the surrounding water is cloudy, as well as, in case of clear water, at the onset of darkness or considerable diving depth.

Therefore, in civilian or military submarines active optical observation systems are also known in which spotlights, attached to the outer hull of the submarine, are normally used to illuminate the observation region with visible light.

Although, in civilian applications this sometimes leads to difficulties due to back-scattering and consequent blinding in cloudy water, active optical observation systems of this kind are widely used at considerable diving depths, in cloudy water, or in fading daylight, despite the fact that use of light sources leads to back-scattering from particles floating in the water.

However, for military deployment active optical observation systems have, as do all other active observation and locating systems, the disadvantage that the emitting radiation source (spotlight) allows, in turn, the observing submarine to itself be localized. Particularly for submarines, whose practical advantage lies in their difficulty to be located, but also for stationary installations, e.g. for the observation of coastal areas, one endeavors to reduce the possibility of location by enemy vehicles or stationary installations, e.g. frigates.

Therefore, it is the purpose according to the invention to further develop a submarine of the above mentioned kind in such a way that a passive optical observation system is made available which, in particular in military applications, allows an improved detection capability also in the event of unfavorable visibility.

This purpose according to the invention is achieved in that the observation window is made part of the passive optical observation system, the entrance pupil of which, exhibits a diameter in excess of 0.1 m.

In this manner, the underlying purpose of the invention is completely achieved. For, in contrast to conventional configurations, the observation window namely serves, at least over a considerable part of its surface, not only as an optically transparent separation between the surrounding water and the interior of the submarine, rather the observation window is actually part of the optical system itself which, consequently, can receive an entrance collimator that, in the extreme case, corresponds to the total opening of said observation window.

In this manner extremely bright passive observations, particularly in regions distant from the submarine, can be performed with exclusively passive observation means so that the submarine emits absolutely no radiation of its own which could be recognized by enemy vehicles or stationary installations and could be used to locate the submarine.

If one considers that in telescopes, the so-called "twilight$_{factor}$" (Dämmerungszahl", Z according to German DIN 58 386 T.1 is defined as the square root of the product of the telescope magnification with the diameter of the entrance pupil, it becomes clear that an enlargement of the entrance pupil from e.g., in the case of conventional viewing devices, 0.05 m to e.g. 2.0 m, i.e. by a factor of 40, leads to an increase in the twilight factor by at least a factor of 6.

It has already been mentioned that in a particularly preferred embodiment of the invention, the entrance pupil has the diameter of the observation window.

This measure has the advantage that an extreme increase in the twilight output becomes possible since the entrance pupil can assume a diameter of up to 3 m.

On the other hand, technically feasible lenses of such large diameter also lead to correspondingly large focal lengths and, therefore, in exit pupils in the centimeter range, to very small opening angles.

Therefore, in another preferred embodiment of the invention, a lens system is used with an entrance pupil whose diameter is smaller than the diameter of the observation window, whereby the lens system is movable along an inner surface of the observation window.

This measure has the advantage that the effective opening angle of the passive optical observation system is considerably enlarged since the lens system which is, e.g. moveable in two dimensions, covers virtually the same volume angle possible in an observation with the naked eye. On the other hand, the conventional observation window is otherwise preserved.

In a preferred improvement of this embodiment, the lens system is gimbal-mounted on a pressure hull of the submarine.

This measure has the advantage that, particularly for small opening angles of the lens system, a disturbance due to the self-motion of the submarine is avoided.

This is true to an even greater extent if the lens system is axis stabilized by means of a gyroscope.

Namely, in this manner, an observation system is established whose optical axle is stably aligned, independent of the submarine's self-motion.

In the embodiments of the invention in which the observation window itself is used as a lens of the passive optical observation system, said observation window can be formed in different ways, in particular convex-concave, plane-convex or bi-convex. A plurality of individual lenses can also be installed on an otherwise uniformly thick glass dome in order to permit different pitch angles of the observation system.

In the cases in which, according to the embodiment of the invention explained above, a movable lens system is utilized at the inner side of the observation window, the thickness of said observation window is preferably constant. However, even in this case, the observation window can be configured as e.g. convex-concave in order to form, in this way, together with the movable lens system, a total multi-lens system in which the refractive index of water is accounted for.

A further group of embodiments is characterized in that the optical observation system is configured as afocal and an image receiver is arranged in a plane intersecting a focus and perpendicular to an optical axis.

This measure has the advantage that special focussing devices are not required since, as is known in the art, in optical systems configured as afocal, the image plane lies in a focal plane.

In preferred improvements of this embodiment, the image receiver is formed as either ocular, or CCD image sensor, or photocell array.

The ocular configuration has the advantage that a direct observation by an observing person is possible and that additional apparatuses are not necessary.

The use of a CCD image sensor has the advantage that a video compatible, low-priced element can be used, as it is in modern video cameras.

Finally, the use of a photocell array has the advantage that additional light intensifying elements can be used. These kinds of elements are known in the art from night viewing devices used for military purposes and have switching means in order to intensify light in the visible or non-visible, particularly in the infrared region, to levels exceeding the sensitivity of the human eye.

Furthermore, it is particularly preferred when, in these cases, the image receiver generates an electronic signal, preferably for screen images, and the signal is processed in an evaluation unit.

This measure has the advantage that methods for image recognition, either new or known in the art, can be used in order to extract from a background, a meaningful pattern which is not recognizable with the naked eye. In this way, the detection level can be further reduced.

Further preferred is a configuration of this embodiment in which the evaluation unit is connected to a sensor to multi-dimensionally ascertain accelerations influencing the observation system or movements of the observation system.

This measure has the advantage that disturbances, such as, in particular, those which can occur for very small opening angles of the observation system when the entire system is subject to a motion, can be reduced. If, namely, the accelerations influencing the submarine or its motion in the three spatial coordinate directions are known, an appropriately programmed evaluation system can calculate those disturbances caused by the effective acceleration on the submarine and/or its motion.

Further advantages can be derived from the description and the accompanying drawings.

Clearly, the features described above and the remaining features which are explained below are applicable not only in the given corresponding combination but also in other combinations or by themselves without departing from the scope of the present invention.

Figure 2:
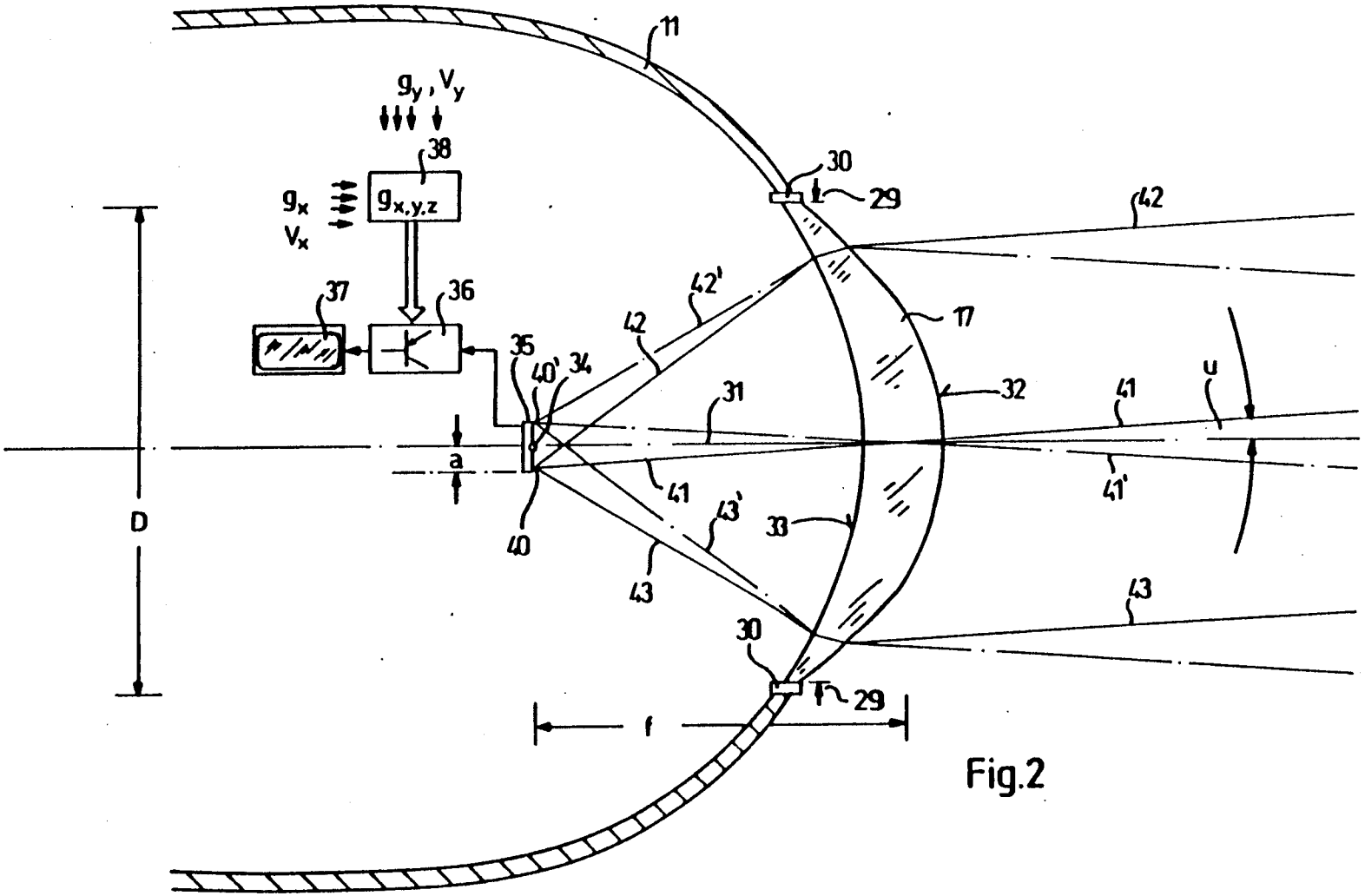
Figure 3:
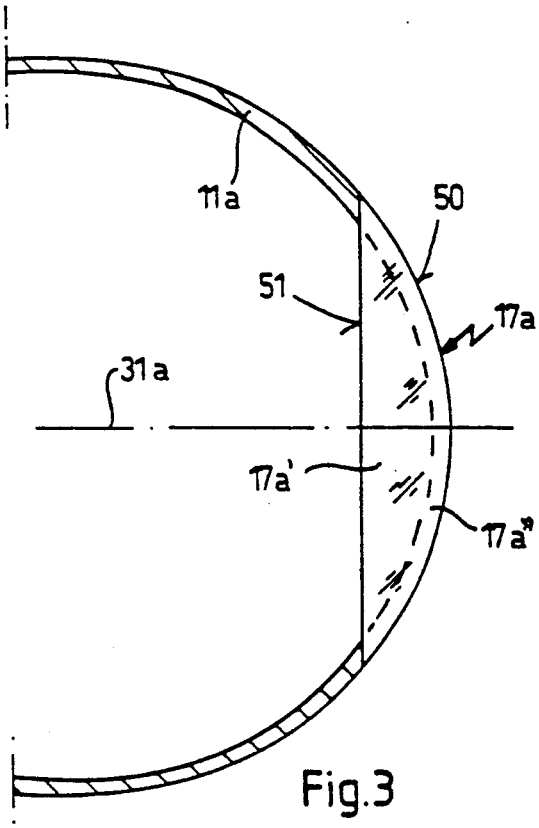
Figure 4:
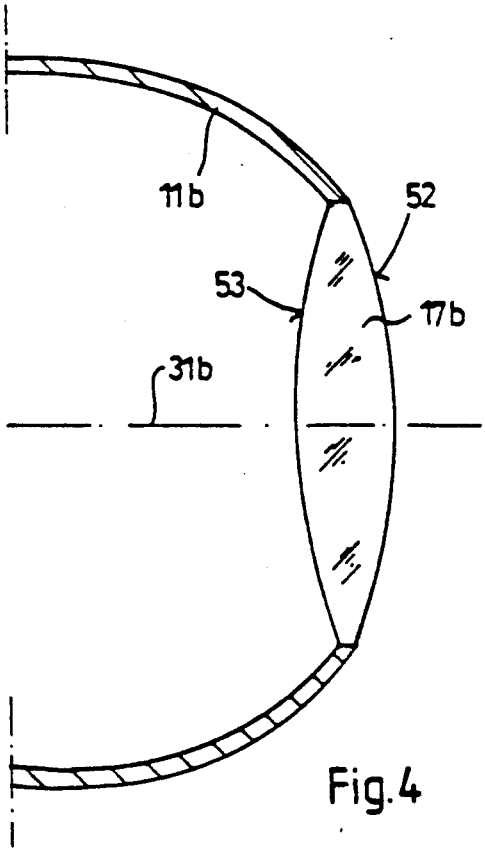
Figure 5:
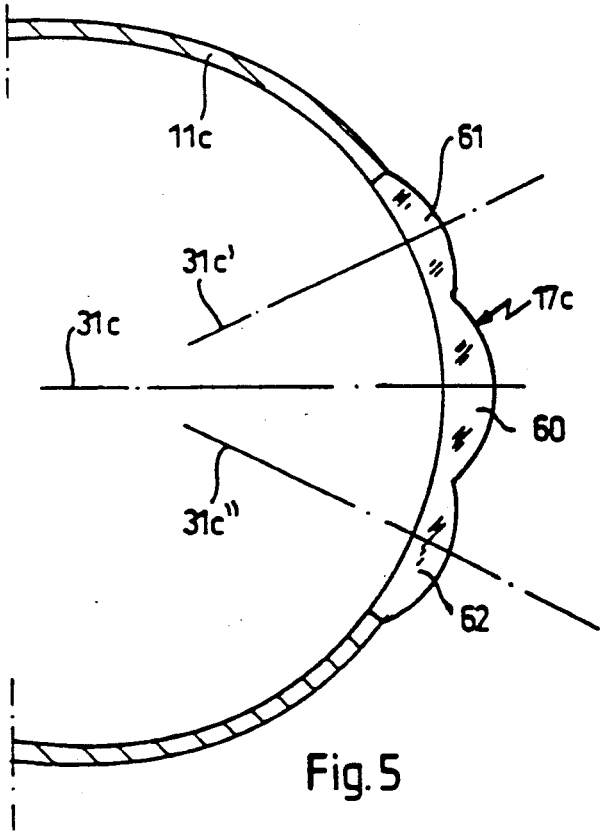
Figure 6:
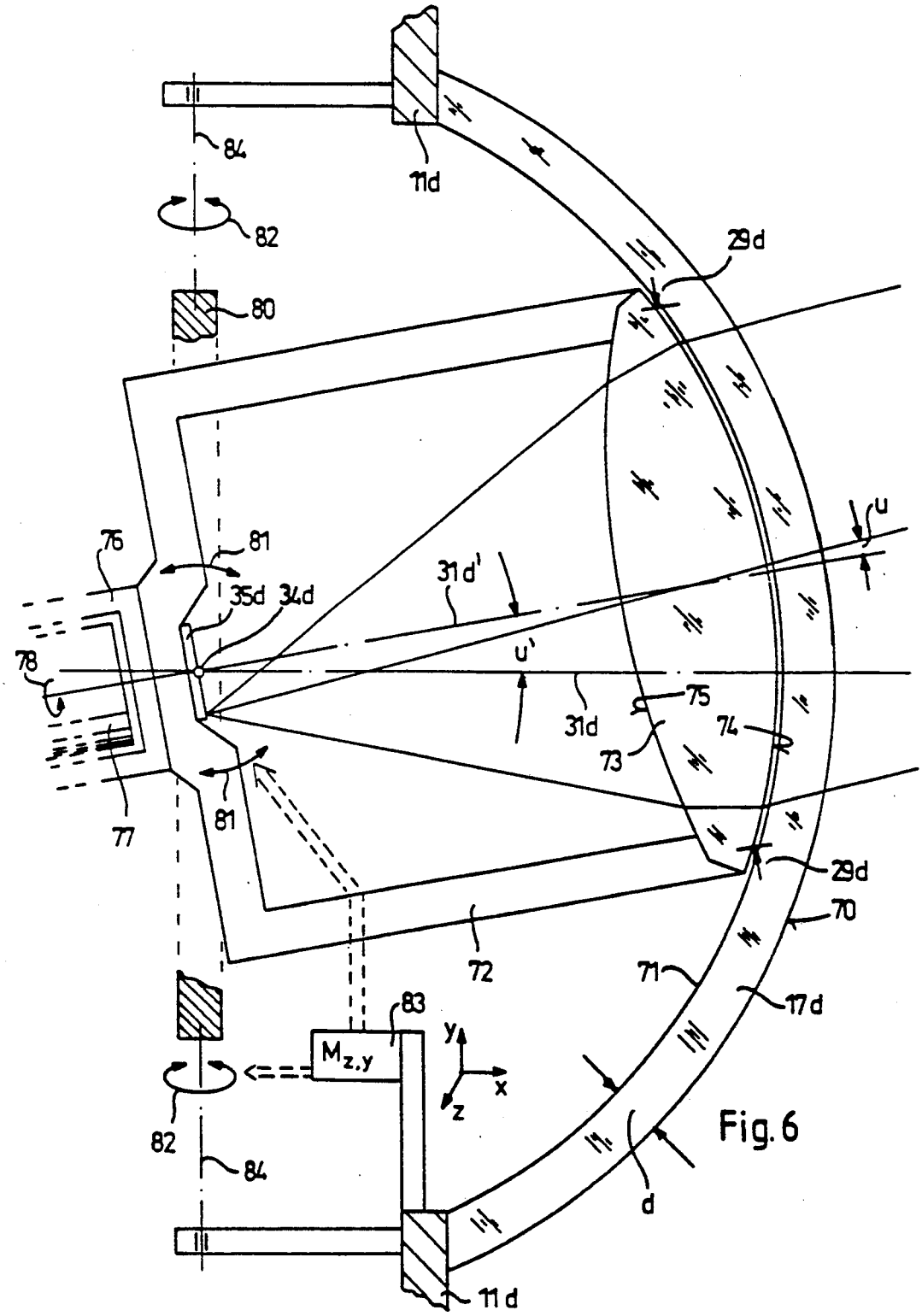

Embodiments of the invention are represented in the drawings and will be further explained in the following description. Shown are:

FIG. 1 a side view of a submarine according to the invention;

FIG. 2 a cross-section through an observation window of the submarine represented in FIG. 1;

FIG. 3 to 5 representations, similar to FIG. 2, however for other configurations of the observation window;

FIG. 6 a cross-section in a further enlarged scale in order to explain a further embodiment of the invention equipped with a movable optical system.

In FIG. 1, 10 designates a side view of a submarine. A pressure hull 11 has the shape of a horizontal cylinder and is closed at its ends with hemispherically shaped or dished bases (Klöpperböden). For propulsion of the submarine 10, a stern propeller 12 as well as lateral manoeuvring propellers 13 and 14 at the stern and the bow are provided for. For dynamic manoeuvring, side/elevator rudders 15 are used. The submarine 10 is partially equipped with a plastic coating 16 in order to achieve a hydrodynamically optimal outer contour.

A first observation window 17 is introduced at the bow of the pressure hull 17. The first observation window 17 is situated behind an acrylic glass coating 18 which, itself, does not serve any pressure separating function.

The first observation window 17 has the shape of a spherical surface section and can be formed as a lens or with uniform thickness, as will be explained further below in greater detail with FIG. 2 through 6.

A second observation window 19 is arranged in the conning tower 20. The second observation window 19 has essentially the form of a transparent hollow sphere, and is sufficiently large to accommodate the head of an observer.

FIG. 2 shows the front side of the first observation window in further detail.

Labeled with 29 is the optically active entrance pupil which is formed by a mount 30 around the observation window 17. The entrance pupil 29 has a diameter D which preferably lies between 0.3 and 3.0 m.

Labeled with 31 is a symmetry axis which is simultaneously the optical axis of the lens shaped observation window 17. The observation window 17 is, namely, equipped with an outer convex surface 32 and with an inner concave surface 33, whereby the radius of curvature of the convex surface 32 is smaller than that of the concave surface 33. The observation window 17 is therefore a converging lens the focus 34 of which lies along the optical axis 31 at a focal distance f from the observation window 17. The focal distance f is of the same order of magnitude as the diameter D of the entrance pupil 29. Clearly, in evaluating the lens, the index of refraction of the water must be considered.

Arranged in a focal plane, i.e. a plane through the focal point 34 and perpendicular to the optical axis 31, is an image receiver 35 which preferably contains electronic image sensing elements. The image receiver 35 can be e.g. a charge shifting element (CCD element), or the image receiver 35 can also be a high sensitivity photocell array, and finally, as an image receiver 35, a conventional ocular can also be used which allows direct visual observation.

If the image receiver 35 is an optical-electrical converter, it is preferably connected to an electronic evaluation unit 36, which, in turn, drives a monitor 37. A three coordinate acceleration or velocity sensor 38 is preferentially connected to the electronic evaluation unit 36 influencing the accelerations gx and gy or velocities vx and vy in the plane of the drawing of FIG. 2.

The optical system represented through the lens-configured observation window 17 is configured as afocal. This means that those objects which are infinitely distant from the observation window 17, in practise at a distance of several focal lengths from the convex surface 32, are sharply imaged at the image receiver 35.

In FIG. 2, the ray path for image receiver 35 edge points 40 and 40' is represented in the manner known in the art, and one notices that the optical system exhibits an opening angle u which is equal to the arctan of the ratio of the half width a of the image receiver to the focal distance f. For the focal length orders of magnitude in the millimeter range and image receiver 35 dimensions in the millimeter or centimeter range which are of interest here, this means that the opening angle u of the optical system lies in the angular degree range or fractions thereof. However, the optical amplification of the system is correspondingly large, and the so-called twilight output Z which corresponds to the square root of the product of the optical amplification and the diameter of the entrance pupil in millimeters, is also correspondingly high. In a practical one could e.g. have:

$D = 100$ cm
$f = 100$ cm
$a = 1$ cm

Then the remaining quantities are given by:

$U = 0.570$
$V = 50$
$Z = 224$

Clearly, these values are to be understood to be only examples, and obviously other combinations of values, multi-lens systems and the like can be utilized in order to satisfy the corresponding individual case requirements.

In view of the very small opening angle u of the optical system of interest here, it is necessary that the system is as mechanically stationary as possible.

In a military application it can, for example, come to pass that the submarine 10 rests on the ground in an appropriate observation position and observes the surroundings from this observation position. Objects passing by at a distance can, namely, be observed by solely passive means without being able, by means of its self-radiation, to locate the submarine itself.

Correspondingly, the submarine can approach unknown objects in crawl-drive (Schleichfahrt), for example sea mines which are floating in water. In this case, the submarine can identify the object at a sufficiently large distance without having to move dangerously close to the object which, should the occasion arise, would lead to the triggering of proximity sensors.

If in this or in other specific cases, an optical observation is necessary while the submarine is traveling, the accelerations influencing the submarine or its velocity or position can be ascertained in several coordinates with the sensor 38. The sensor signals will be transformed into the corresponding correction values in the evaluation unit 36, in order to calculate the influence of the motion of the submarine on the received images.

FIG. 3 through 5 show several variations of observation windows which can be used within the context of the present invention.

FIG. 3 shows an observation window 17*a* with its outer convex surface 50 and an inner flat surface 51, so that the observation window 17*a*, in this manner, assumes the shape of a plane-convex lens. 17*a'* and 17*a''* indicate that the lens can be comprised of a window part 17*a''* of constant thickness for conventional panoramic observation as well as from a removable lens part 17*a'* which can be implemented when required.

FIG. 4 shows, on the other hand, an observation window 17*b* with an outer convex surface 52 and an inner likewise convex surface 53, so that, in this manner, a bi-convex lens is formed.

In the embodiment of FIG. 5, an observation window 17*c* is provided for in which several individual lenses 60,61,62 of identical or differing construction are introduced. In the embodiment represented in FIG. 5, the individual lenses 60 through 62 are essentially of identical construction and each is concave-convex in form. A central individual lens 60 lies on the optical axis 31*c*, while both of the other individual lenses 61 and 62 lie on optical axes 31*c'* and 31*c''* which are inclined at angles to said optical axis 31*c*.

Clearly, other additional individual lenses can be arranged in a direction perpendicular to the plane of the drawing of FIG. 5, such that a type of facetted eye is formed, the individual facets (individual lenses) of which can be provided with either separate image receivers each, or with a common image receiver which is switchable either mechanically or by means of light guides to the different individual lenses 60 through 62.

Finally, FIG. 6 shows another further embodiment with an observation window 17*d* which exhibits an outer convex surface 70 as well as an inner concave surface 71 in such a way that the thickness d of the observation window 17*d* is uniform.

A lens 73 is arranged in a moveable first frame 72, said lens having an outer convex surface 74 whose radius of curvature preferably conforms to the radius of curvature of the inner concave surface 71 of the observation window 17*d*. The inner, likewise convex surface 75 of the lens 73 results in a bi-convex lens.

The first frame 72 can be swung about an axis which is perpendicular to the plane of the drawing of FIG. 6 and passes through the focal point 34*d* of the lens 73. A counterweight 76 is arranged at the rear of the first frame 72, in the left half of FIG. 6, in order to keep frame 72 in neutral equilibrium. A gyroscope 77, which is only schematically indicated, is part of the counterweight 76, the axis of rotation of said gyroscope being coincident with the optical axis 31*d*' of the lens 73.

The optical axis 31*d*' can, by moving the first frame 72, over a wide range, be placed at an angle u' with respect to the symmetry axis 31*d* of the observation window. If the opening angle of the optical system formed with lens 73 has a value u, then, as was explained further above in connection with FIG. 2, an optical system results whose self-opening u can be substantially enlarged by swinging the first frame 72. Hereby, the alignment of the optical axis 31*d*' of the lens 73 is stabilized by means of the gyroscope 77 which is rotating about the optical axis 31*d*' in the direction of arrow 78.

The lens 73 is, thereby, gimbal mounted in that the first frame 72, in turn, is mounted in a second frame 80 which extends perpendicular to the plane of the drawing of FIG. 6. The first frame 72 is thereby constrained to rotate about an axis in the second frame 80, said axis running perpendicularly to the plane of the drawing of FIG. 6 through the focal point 34*d*. The swivel motion of the first frame 72 is indicated with arrow 81 in FIG. 6.

The second frame 80 is, in turn, rotatable about a vertical axis 84 as indicated by arrow 82.

The axis 84 passes, in turn, through mounting points which are rigidly coupled to the pressure hull 11*d*.

Finally, a rotation unit 83 is also provided for which is likewise rigidly coupled to the pressure hull 11*d* and, via activating couplings drawn as dashed lines in FIG. 6, allows a rotation of the second frame 80 about the axis 84 in the direction of arrow 82 and, on the other hand, a rotation of the first frame 72 about the axis passing through the focal point 34*d* in the direction of arrow 81.

This means, in effect, that the lens 73 can be positioned to an arbitrary location at the inner surface 71 of the observation window 17*d* and there, in consequence of the inertia of the gyroscope 77, remains stationary, even if the submarine is spatially moving. The optical axis 31*d*' remains, in this case, stably aimed at a target point, even when the pressure vessel 11*d* should move its spatial coordinates. Target tracking of a moving target is likewise possible through appropriate movement of lens 73.

Although the entrance pupil 29*d* of lens 73 is smaller than the entire entrance pupil of the observation window 17*d*, one nevertheless attains, using the configuration according to FIG. 6, a field of view which is enlarged by several orders of magnitude since, in the plane of the drawing of FIG. 6, the opening angle u is of order of magnitude of several degrees while the swivel angle u' can assume a value of e.g. 400.

I claim:

1. An underwater vehicle having a pressure hull and having a passive optical observation system, said optical observation system having an entrance pupil with a diameter of more than 0.1 m and comprising:

an observation window having a diameter in the range from 0.3 to 3.0 m and having a curved surface;

a lens system with an entrance pupil, the diameter of which is less than the diameter of said observation window, said lens system being gimbal mounted to said pressure hull, having axes about which it may be rotated, and being stabilized with respect to said axes by means of a gyroscope; and means for moving said lens system along an inner surface of said observation window.

2. An underwater vehicle having a passive optical observation system, said optical observation system having an entrance pupil with a diameter of more than 0.1 m and comprising:

an observation window having a diameter in the range from 0.3 to 3.0 m and at least one curved surface, said optical observation system being afocal; and an image receiver arranged in a plane running through a focus of said observation system and perpendicular to an optical axis thereof.

3. The underwater vehicle of claim 2, wherein said image receiver is an ocular.

4. The underwater vehicle of claim 2, wherein said image receiver is a charge-coupled device (CCD)-image sensor.

5. The underwater vehicle of claim 2, wherein said image receiver is a photocell array.

6. The underwater vehicle of claim 1, wherein said image receiver generates an electronic signal, preferably for screen images, said signal being processed in an evaluation unit.

7. The underwater vehicle of claim 6, wherein said evaluation unit is connected to a sensor for multi-dimensionally detecting accelerations or movements of said underwater vehicle influencing said observation system.

8. The underwater vehicle of claim 6, wherein said evaluation unit is connected to a sensor to multi-dimensionally detect movements of said observation system.

* * * * *